US011053619B2

(12) United States Patent
Park et al.

(10) Patent No.: US 11,053,619 B2
(45) Date of Patent: Jul. 6, 2021

(54) SMART AUTO WASH CYCLE FOR A WASHING MACHINE APPLIANCE

(71) Applicant: Haier US Appliance Solutions, Inc., Wilmington, DE (US)

(72) Inventors: Seung-Yeong Park, Seongnam (KR); JaeHyo Lee, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 766 days.

(21) Appl. No.: 15/907,488

(22) Filed: Feb. 28, 2018

(65) Prior Publication Data

US 2019/0264363 A1 Aug. 29, 2019

(51) Int. Cl.

| | |
|---|---|
| ***D06F 33/00*** | (2020.01) |
| ***D06F 35/00*** | (2006.01) |
| ***D06F 34/18*** | (2020.01) |

(52) U.S. Cl.

CPC ..... *D06F 33/00* (2013.01); *D06F 34/18* (2020.02); *D06F 35/006* (2013.01); *D06F 2212/06* (2013.01); *D06F 2216/00* (2013.01)

(58) Field of Classification Search

None

See application file for complete search history.

(56) References Cited

U.S. PATENT DOCUMENTS 4,862,710 A * 9/1989 Torita ..... D06F 34/18 68/12.01

2017/0191204 A1 7/2017 Shin et al.

FOREIGN PATENT DOCUMENTS

KR 20100081218 A 7/2010

* cited by examiner

*Primary Examiner* — Rita P Adhlakha

(74) *Attorney, Agent, or Firm* — Dority & Manning, P.A.

(57) ABSTRACT

A washing machine appliance with smart automatic washing functionality is provided. The washing machine automatically senses the amount of articles within a wash chamber defined by the washing machine appliance and runs the wash cycle automatically when the amount of articles within the wash chamber is greater than a minimum load size threshold and less than a maximum load size threshold. Methods for providing such smart automatic washing functionality are also provided.

14 Claims, 4 Drawing Sheets

SMART AUTO WASH CYCLE FOR A WASHING MACHINE APPLIANCE

FIELD OF THE INVENTION

The present subject matter relates generally to washing machine appliances and methods for operating washing machine appliances in auto wash cycles.

BACKGROUND OF THE INVENTION

Washing machine appliances generally include a tub for containing wash fluid, e.g., water, detergent, fabric softener, bleach, and/or combinations thereof, during operation of such washing machine appliances. A wash basket is rotatably mounted within the tub and defines a wash chamber for receipt of articles for washing. During operation of such washing machine appliances, wash fluid is directed into the tub and onto articles within the wash basket. The wash basket and/or an agitation element can rotate at various speeds to agitate articles within the wash basket in the wash fluid, to wring wash fluid from articles within the wash basket, etc.

Conventionally, users have been required to start wash cycles of washing machine appliances manually, e.g., by turning a knob, pressing buttons, sending a command to the washing machine appliance via a connected device, etc. Stated differently, users have been required to directly interact with the washing machine appliance to start a wash cycle. This may be an inconvenience for users, for example. Further, in addition to being required to start the washing machine manually, users have been responsible for determining whether their laundry loads are too small or too large. Many times, users run wash cycles with minimal laundry articles within the wash chamber, which is not energy efficient. In some instances, such small loads cause out-of-balance loads, particularly during spin cycles. Such out-of-balance loads can harm the washing machine appliance. Moreover, when users attempt to wash a load that is too large, the load size may exceed the washing machine appliance's load capacity, which may damage the washing machine appliance.

Accordingly, a washing machine appliance and methods of operation therefore that address one or more of the challenges noted above would be useful.

BRIEF DESCRIPTION OF THE INVENTION

The present subject matter provides a washing machine appliance with smart automatic washing functionality. The washing machine automatically senses the amount of articles within a wash chamber defined by the washing machine appliance and runs the wash cycle automatically when the amount of articles within the wash chamber is greater than a minimum threshold and less than a maximum threshold. Methods for providing such smart automatic washing functionality are also provided. Additional aspects and advantages of the invention will be set forth in part in the following description, or may be apparent from the description, or may be learned through practice of the invention.

In one exemplary embodiment, a method for operating a washing machine appliance in an auto wash cycle is provided. The method includes determining if a lid of the washing machine appliance is in a closed position. The method further includes detecting a load size of articles within a wash chamber of the washing machine appliance if the lid is in the closed position. The method also includes ascertaining if the load size is greater than a minimum load size threshold. Further, the method includes ascertaining if the load size is less than a maximum load size threshold. Moreover, the method includes executing the auto wash cycle based at least in part on the load size if the load size is greater than the minimum load size threshold and less than the maximum load size threshold.

In another exemplary embodiment, a washing machine appliance is provided. The washing machine appliance includes a cabinet and a wash tub mounted within the cabinet and defining a wash chamber. The washing machine appliance also includes a wash basket positioned within the tub, the wash basket configured to receive articles for washing. Further, the washing machine appliance includes a lid rotatably mounted to the cabinet and selectively movable between an open position and a closed position. In addition, the washing machine appliance includes a controller configured to: determine if a current time has met a scheduled time; determine if the lid is in the closed position; execute a load size sensing cycle to detect a load size of articles within the wash chamber if the lid is in the closed position and the current time has met the scheduled time; ascertain if the load size is greater than a minimum load size threshold; ascertain if the load size is less than a maximum load size threshold; and execute the auto wash cycle based at least in part on the load size if the load size is greater than the minimum load size threshold and less than the maximum load size threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
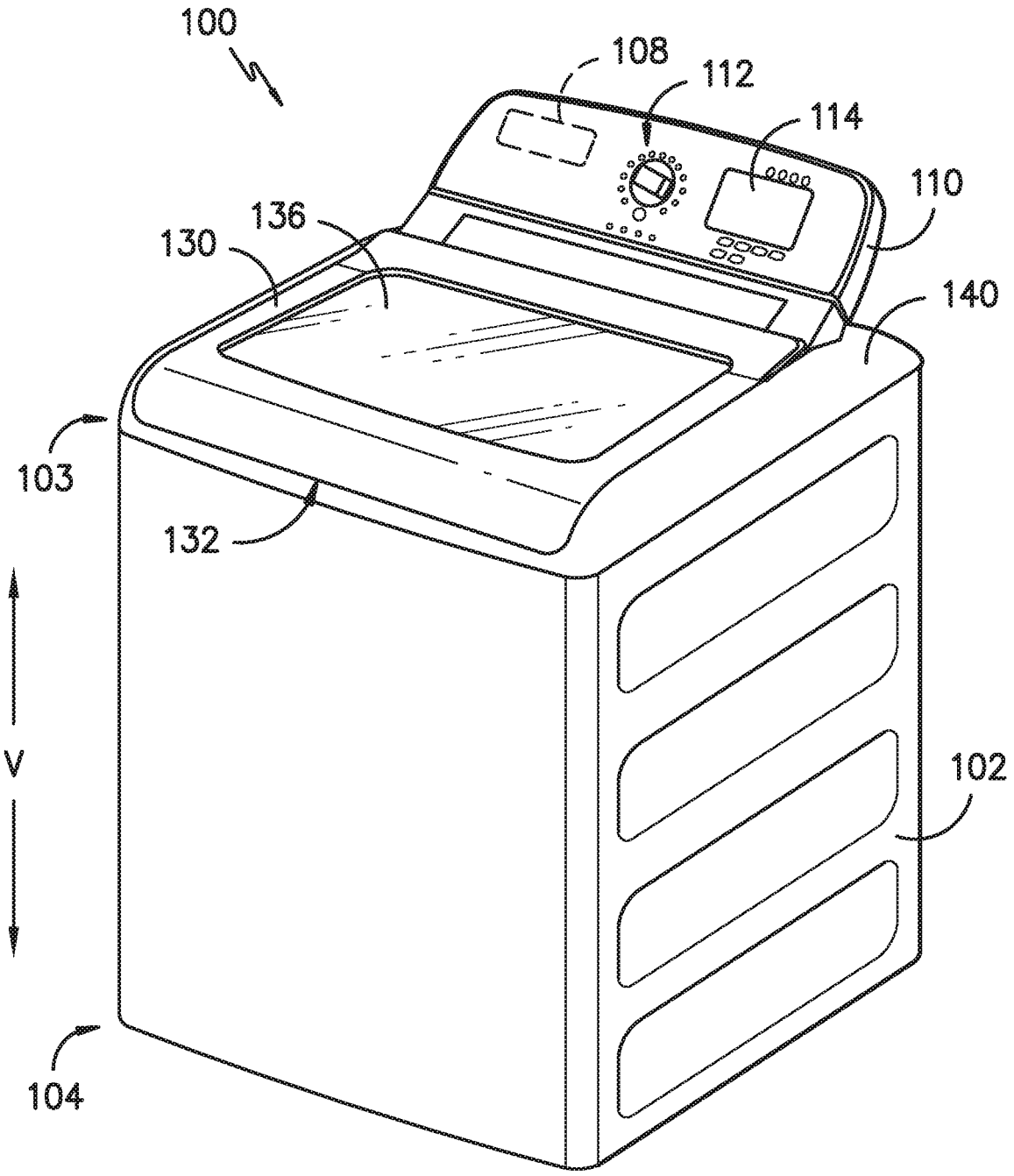
FIG. 1 provides an exemplary washing machine appliance according to various exemplary embodiments of the present disclosure with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
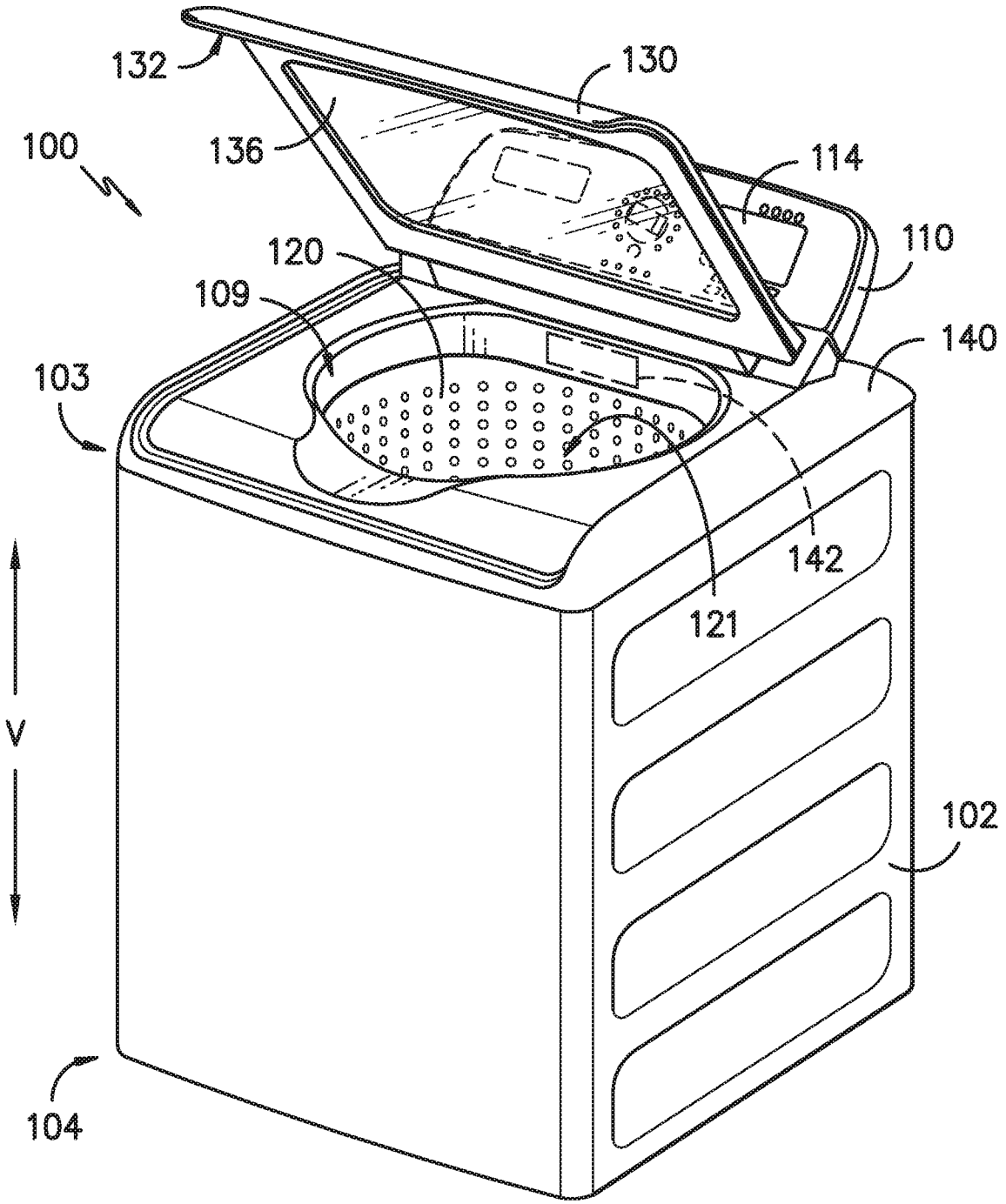
FIG. 2 provides the washing machine appliance of FIG. 1 with the door shown in an open position.

FIGS. 1 and 2 provide an exemplary embodiment of a vertical axis washing machine appliance 100. In FIG. 1, a door or lid 130 is shown in a closed position. In FIG. 2, lid 130 is shown in an open position. Thus, lid 130 is movable between a closed position and an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. In particular, wash basket 120 is received within a wash chamber defined by a wash tub 121 (FIG. 2) and is configured for receipt of articles for washing. Wash tub 121 holds wash and rinse fluids for agitation in wash basket 120 within wash tub 121. Wash basket 120 includes a plurality of openings or perforations (FIG. 2) therein to facilitate fluid communication between wash basket 120 and wash tub 121.

Cabinet 102 of washing machine appliance 100 has a top panel 140. Top panel 140 defines an opening 109 (FIG. 2) that permits user access to wash basket 120 of wash tub 121. Lid 130, rotatably mounted to top panel 140, permits selective access to opening 109; in particular, lid 130 selectively rotates between the closed position shown in FIG. 1 and the open position shown in FIG. 2. In the closed position, lid 130 inhibits access to wash basket 120. Conversely, in the open position, a user can access wash basket 120. A window 136 in lid 130 permits viewing of wash basket 120 when lid 130 is in the closed position, e.g., during operation of washing machine appliance 100. Lid 130 also includes a handle 132 that, e.g., a user may pull and/or lift when opening and closing lid 130. Further, although lid 130 is illustrated as mounted to top panel 140, alternatively, lid 130 may be mounted to cabinet 102 or any outer suitable support.

A spout 142 is configured for directing a flow of fluid into tub 121. In particular, spout 142 may be positioned at or adjacent a top portion of wash basket 120. Spout 142 may be in fluid communication with a water supply (not shown) to direct fluid (e.g., liquid water) into wash tub 121 and/or onto articles within wash basket 120. A valve (not shown) regulates the flow of fluid through spout 142. For example, the valve can selectively adjust to a closed position to terminate or obstruct the flow of fluid through spout 142. A flow limiter also may be included such that a known flow rate is provided from the valve to spout 142. In addition, washing machine appliance 100 may include a fluid additive dispenser (not shown) for receipt of one or more fluid additives, e.g., detergent, fabric softener, and/or bleach, to dispense to articles during one or more cycles of washing machine appliance 100. Further, a pump assembly (not shown) may be located beneath wash tub 121 and wash basket 120 for gravity assisted flow to drain tub 121.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Figure 3:
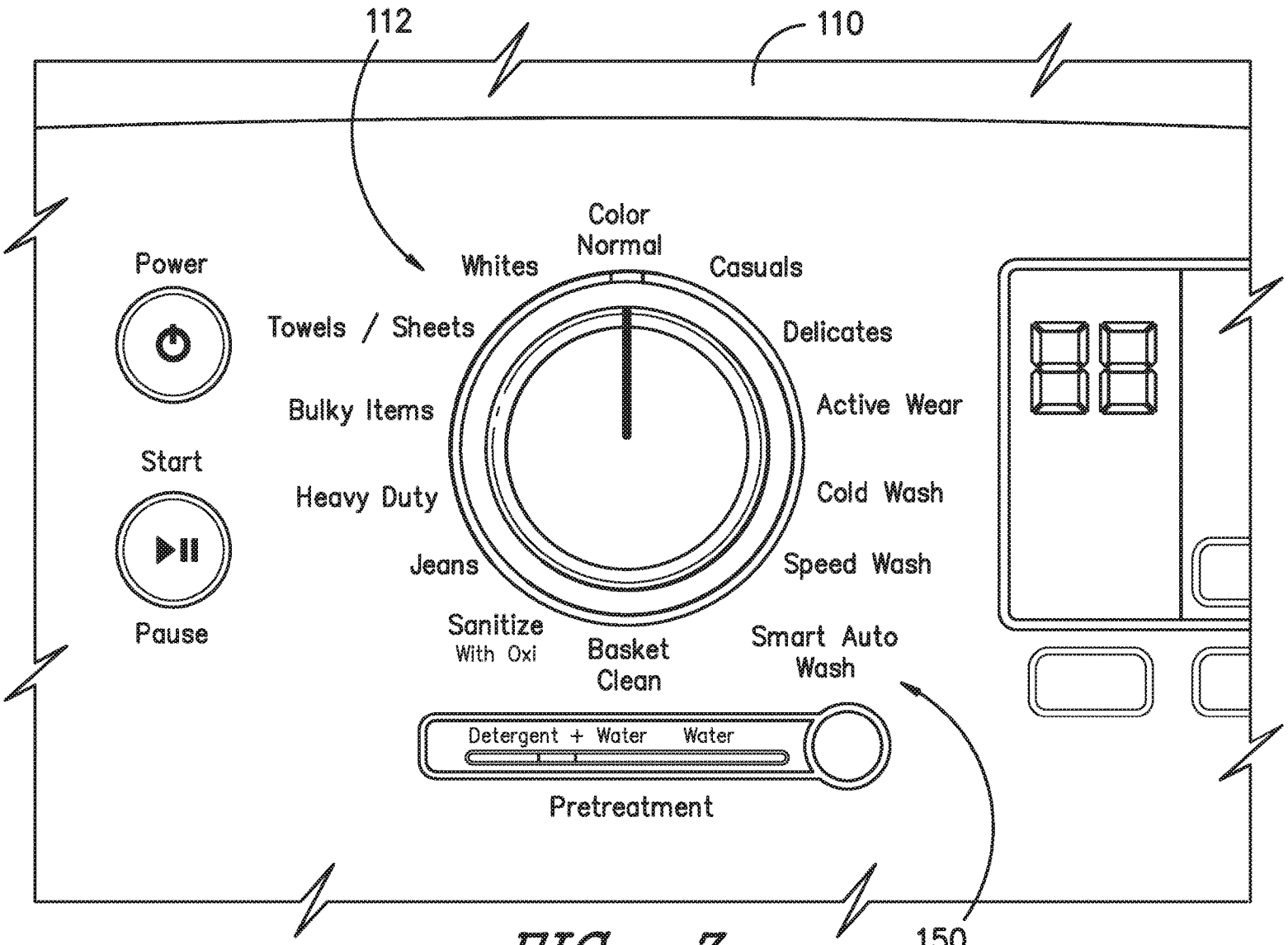
FIG. 3 provides a close up view of the control panel of the washing machine appliance of FIGS. 1 and 2.

FIG. 3 provides a close up view of control panel 110 of washing machine appliance 100 of FIGS. 1 and 2. As shown for this embodiment, in accordance with exemplary aspects of the present disclosure, control panel 110 of washing machine appliance 100 includes a smart auto wash feature 150 that, when selected, automatically washes articles within the wash chamber of washing machine appliance 100 if certain conditions are met. Such operation will be described herein with reference to methods (300) and (400). In some exemplary embodiments, a user may select the smart auto wash cycle 150 remotely via a user device.

Operation of washing machine appliance 100 is controlled by a controller 108 (FIG. 1). Controller 108 is communicatively coupled with control panel 110 so that controller 108 may control washing machine appliance 100 in accordance with selected washing machine cycles and features, e.g., such as the auto wash feature depicted in FIG. 3. Controller 108 may include a communication interface that may allow for controller 108 to communicate with various user devices communicatively coupled with washing machine appliance 100, e.g., via a wired and/or wireless network. Example user devices include smart phones, home assistant devices, watches, etc. Users may select washing machine cycles and features via their user devices and such selections may be routed to washing machine appliance 100. In response to a user's selected wash cycle and features, controller 108 operates the various components of washing machine appliance 100 to execute the selected machine cycles and features.

Controller 108 may include a memory device and a processor, such as a general or special purpose microprocessor operable to execute programming instructions or micro-control code associated with a wash cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 108 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses. Moreover, as noted above, controller 108 may include a communication interface to communicate with various user devices.

In an illustrative embodiment, laundry items or articles are loaded into wash basket 120 through opening 109, and washing operation is initiated through operator manipulation of input selectors 112 or through smart auto wash functionality of washing machine appliance 100, as will be descried in detail herein. Wash tub 121 is filled with water and detergent and/or other fluid additives from, e.g., the fluid additive dispenser, to form wash and rinse fluids. One or more valves can be opened to initiate a flow of fluid into wash basket 120 via a spout for filling wash tub 121 to the appropriate level for the load size or amount of articles being washed and/or rinsed. Once wash basket 120 is properly filled with fluid, the contents of wash basket 120 can be agitated (e.g., with an agitation element) for washing of laundry items in wash basket 120.

After the agitation phase of the wash cycle is completed, wash tub 121 can be drained. Laundry articles can then be rinsed by again adding fluid to wash basket 120 depending on the specifics of the cleaning cycle. The agitation element may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by moving lid 130 to an open position and then reaching into wash basket 120 through opening 109.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may also be utilized with the present subject matter as well.

Figure 4:
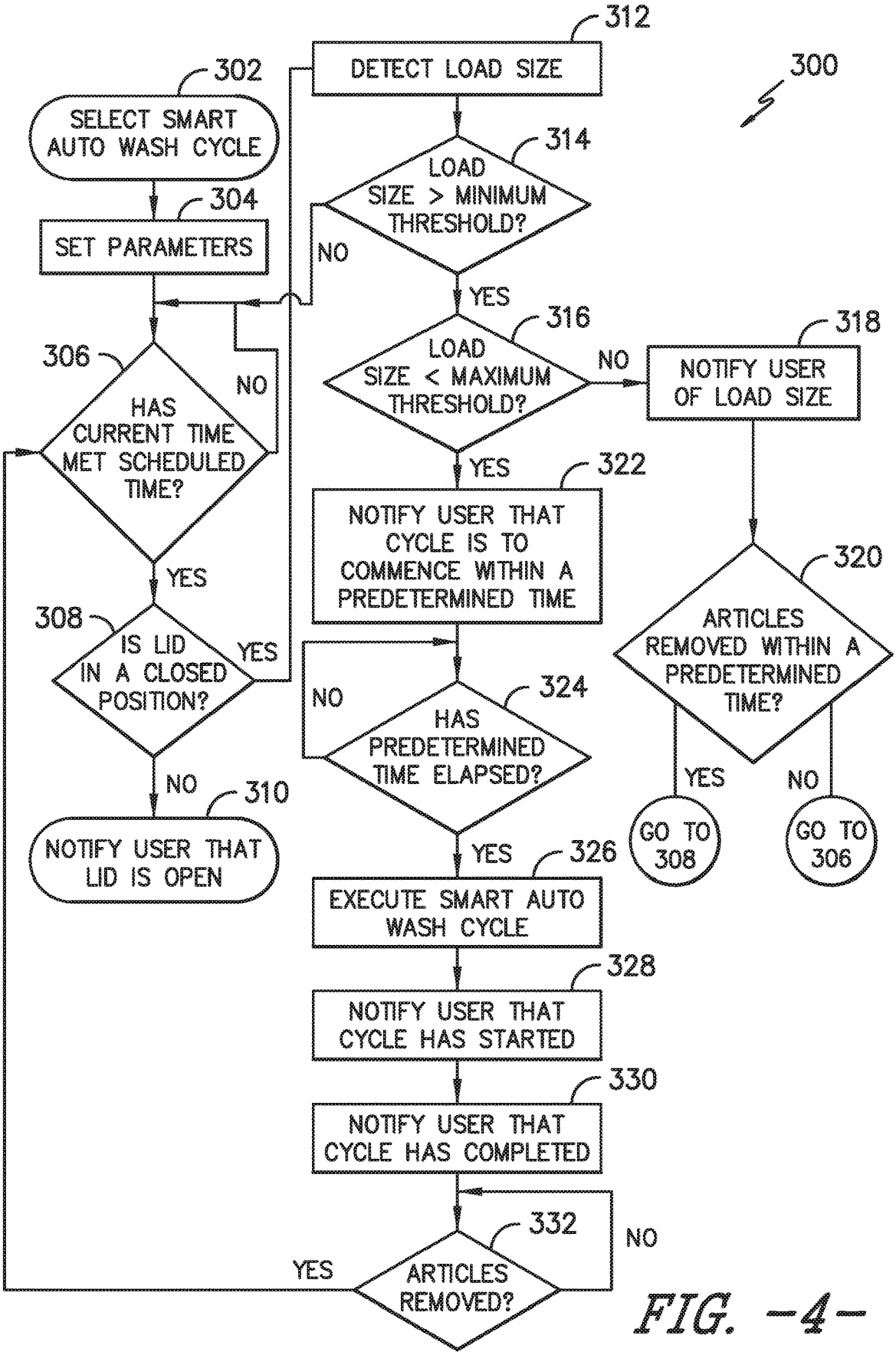
FIG. 4 provides a flow diagram of an exemplary method for operating a washing machine appliance in a smart auto wash cycle according to various exemplary embodiments of the present disclosure.

FIG. 4 provides a method (300) of operating a washing machine appliance in a smart auto wash cycle according to an exemplary embodiment of the present disclosure. Method (300) may be used to operate any suitable washing machine appliance, such as washing machine appliance 100 of FIGS. 1 and 2. Accordingly, reference numerals used to indicate features of washing machine appliance 100 of FIGS. 1 and 2 will be utilized below to provide context to method (300). Further, method (300) may be programmed into and implemented in whole or in part by controller 108 (FIG. 1) of washing machine appliance 100. Utilizing method (300), controller 108 can operate washing machine appliance 100 automatically. More particularly, controller 108 can control washing machine appliance 100 to perform wash cycles automatically without user interaction with washing machine appliance 100.

At (302), method (300) includes selecting the smart auto wash cycle. For instance, a user may select the smart auto wash cycle by manipulating one or more input selectors 112, e.g., by turning a rotary dial as shown in FIG. 3. As another example, a user may select the smart auto wash cycle by selecting the cycle via a drop-down menu, by entering the desired cycle, or by a voice command on an application running on a user device communicatively coupled with controller 108 of washing machine appliance 100. As will be appreciated, the smart auto wash cycle may be selected in other suitable manners as well.

As yet another example, the smart auto wash cycle may be set as the default wash cycle. In this way, the smart auto wash cycle need not be selected at all, as it is the default wash cycle. Accordingly, users may place their laundry items into washing machine appliance 100 and the washing machine appliance 100 will wash the laundry items using the smart auto wash cycle without need for the user to select the smart auto wash cycle, or any wash cycle.

At (304), method (300) includes setting one or more parameters of the smart auto wash cycle. For instance, a user may set various parameters regarding how and when the smart auto wash cycle is to be implemented. The user may set the one or more parameters of the cycle in any suitable manner, e.g., through manipulation of input selectors 112, by voice command to washing machine appliance 100 or a user device, etc. Alternatively, the parameters may be set as the default settings, e.g., that are set by the manufacturer of washing machine appliance 100. Parameters that may set at (304) include one or more load size thresholds, how to treat or wash certain types of fabrics, the temperature of the wash fluid dispensed into the wash chamber, the means or media in which the user prefers to be notified about the smart auto wash cycle (e.g., via text, voice command, email, etc.), etc.

A user may set or reconfigure parameters of the smart auto wash cycle before, during, or after a smart auto wash cycle. A user may set or reconfigure the parameters of the smart auto wash cycle by any suitable means, such as e.g., by a mobile application running on a user device, via voice control, by manipulation of one or more input selectors 112, etc. In some instances, washing machine appliance 100 may alter or change the parameters that are available to be set or reconfigured by a user during a run time of smart auto wash cycle. For instance, certain parameters may be invalid or unavailable for certain steps of the cycle. For example, if washing machine appliance 100 is performing a load sensing step, controller 108 may designate the load size thresholds as invalid such that they may not be altered at least until the load sensing cycle is completed.

For this implementation of method (300), setting the one or more parameters includes setting a "scheduled time" in which the smart auto wash cycle control logic is to proceed forward to see if the conditions are appropriate to run an auto wash cycle. For instance, the scheduled time may be set for a set time on a predetermined interval. As one example, the scheduled time may be set for a set time of "6 pm" on a predetermined interval of "daily" or "every day of the week." As another example, the scheduled time may be set for a set time of "3 pm" on a predetermined interval of "every two days." Preferably, the predetermined interval is set as for occurring at least once a day or on a daily basis. In this way, the current time will meet the scheduled time at least once a day, and thus, articles will not continue to go unwashed for prolonged periods. In alternative embodiments, the scheduled time may be set for a predetermined operating period on a predetermined interval. As one example, the scheduled time may be set for a predetermined operating period of "7 pm to 9 pm" on a predetermined interval of "every three days." Additionally, in some implementations, the scheduled time may be set to "always" or an "always on" setting such that the load size sensing cycle as executed at (312) is not dependent on the current time but rather only on lid 130 being closed as determined at (308).

At (306), once the smart auto wash cycle is selected at (302) and the parameters are set at (304), method (300) includes determining if a current time has met a scheduled time. For instance, if the scheduled time is set for a set time of "6 pm" on a predetermined interval of "every day," then controller 108 checks the current time against 6 pm. According, for this example, each day when the current time is 6 pm, the current time has met the scheduled time. As another example, if the scheduled time is set as a predetermined operating period, e.g., "between 7 pm and 9 pm" on a predetermined interval of "every three days," and the current time is "between 7 pm and 9 pm" on one of the designated days, then the current time has met the scheduled time. If the scheduled time is set to the "always on" setting, then the current time has met the scheduled time and will continue to do so regardless of the current time. As shown in FIG. 4, if the current time has not met the scheduled time, the control logic loops back to (306) to continue checking if the current time has met the scheduled time. If the current time has met the scheduled time, the smart auto wash cycle logic proceeds to (308).

At (308), method (300) includes determining if a lid of the washing machine appliance is in a closed position. Stated alternatively, at (308), method (300) includes determining whether lid 130 is an open position or closed position. Determining whether lid 130 is in an open or closed position is done for safety purposes, among other reasons. In particular, determining whether lid 130 is an open or closed position is done to ensure that it is safe to proceed with performing a load size sensing cycle at (312). For instance, during a load size sensing cycle, wash basket 120 may be rotated relative to wash tub 121 at relatively high speeds, and to ensure the safety of users, lid 130 is preferably closed during the load sensing cycle to prevent users from reaching into the wash chamber. As shown in FIG. 4, if lid 130 is not detected to be in the closed position (i.e., lid 130 is open), the smart auto wash cycle logic proceeds to (310). If lid 130 is in the closed position, the smart auto wash cycle logic proceeds to (312).

At (310), if lid 130 is not detected in the closed position as determined at (308), method (300) includes notifying a user that the lid is not in the closed position. The user is notified so that the user may take corrective action to close lid 130. As noted above, if lid 130 is not closed (i.e., it is in the open position), the smart auto wash cycle will not run and the user's articles will not be washed. Thus, the user is notified. Notifying the user that lid 130 is not in the closed position may be done in a number of suitable manners. For instance, as one example, washing machine appliance 100 may sound an alarm, washing machine appliance 100 may send a push notification to a user's device, e.g., a user's smart phone, and/or washing machine appliance 100 or a user's device may notify a user via a voice communication. Washing machine appliance 100 may notify users of the open lid condition in other suitable manners as well.

At (312), if lid 130 is detected in the closed position as determined at (308), method (300) includes detecting a load size of articles within a wash chamber of the washing machine appliance. That is, a load size sensing cycle is performed to ascertain the amount of articles within the wash chamber. The auto wash cycle performed depends on the load size detected. For instance, based on the detected load size, controller 108 may categorize the load size into a load size class or category. For example, the detected load size may be categorized as small, medium, or large. Based on the load size, the volume of wash fluid dispensed into the wash chamber, the sub cycle times of the auto wash cycle (e.g., wash cycle, spin cycle, rinse cycle, drain cycle, etc.), and other parameters of the auto wash cycle may be modified or altered in accordance with the load size when the auto wash cycle is run. Further, when the auto wash cycle is selected at (302), a user may place articles within the wash chamber whenever such articles become soiled or dirty. However, washing machine appliance 100 only washes the articles if certain conditions are met (e.g., the conditions as explained at (314) and (316)). Before making such ascertaining whether such conditions are met, the load size must first be detected and determined at (312).

The load size may be detected in a number of suitable manners. For instance, the load size may detected by estimating the mass of the load of articles in wash basket 120 via a dry load sensing method. As an example, controller 108 may estimate the mass of the load based upon the inertia of the articles within the wash chamber. To determine the inertia of the articles within the wash chamber, wash basket 120 is rotated by a motor within wash tub 121, e.g., controller 108 can activate the motor to rotate basket 120. Further, controller 108 can operate motor such that basket 120 rotates at a predetermined frequency or angular velocity. The predetermined frequency or angular velocity can be any suitable frequency or angular velocity. For example, the predetermined frequency or angular velocity may be about one hundred and twenty revolutions per minute (120 rpm). Next, controller 108 can utilize motor to adjust an angular velocity of wash basket 120. As an example, controller 108 can deactivate the motor, e.g., by shorting the windings of the motor using any suitable mechanism or method, to adjust the angular velocity of wash basket 120. Then, controller 108 can determine an angular acceleration or first derivative of the angular velocity of wash basket 120, or a jerk or a second derivative of the angular velocity of wash basket 120, e.g., based at least in part the adjustment of the angular velocity of wash basket 120. Based upon the first and/or second derivative of the angular velocity of wash basket 120, controller 108 can estimate an inertial mass of the articles within wash basket 120. As an example, the magnitude of the first and/or second derivative of the angular velocity of basket 120 can be inversely proportional to the mass of the articles within wash basket 120. Thus, controller 108 can correlate the magnitude of the first and/or second derivative of the angular velocity of wash basket 120 to the mass of articles within wash basket 120 at (314). Other ways of detecting the load size may be used as well. For instance, any of the methods of ascertaining the load size of articles within wash basket 120 disclosed in U.S. Pat. No. 5,161,393, the entire contents of which are hereby incorporated by reference, may be used.

At (314), after the load size is detected at (312), method (300) includes determining if the load size is greater than a minimum load size threshold. The minimum load size threshold may be set by a user or may be a default setting, for example. If the detected load size is less than or equal to the minimum load size threshold, controller 108 determines that there is an insufficient load size to warrant running the washing machine appliance 100. In this way, energy can be conserved. If the load size is not greater than the minimum load size threshold, the control logic loops back to (306) to determine whether the current time has met the scheduled time. On the other hand, if the load size is greater than the minimum load size threshold, the control logic proceeds to (316).

At (316), method (300) includes determining if the load size is less than a maximum load size threshold. The maximum load size threshold may be set by a user or may be a default setting, for example. If the detected load size is greater than or equal to the maximum load size threshold, controller 108 determines that the load size of the articles within wash basket 120 exceed the washing machine's load capacity. This may, for example, prevent damage to washing machine appliance 100. If the load size is less than the maximum load size threshold, the control logic proceeds to (322) so that washing machine appliance 100 may execute the smart auto wash cycle. If the load size is not less than the maximum load size threshold, the control logic proceeds to (318).

At (318), method (300) includes notifying a user that the load size is not less than the maximum load size threshold. The user is notified so that the user may take corrective action to reduce the load size of the articles within the wash chamber of washing machine appliance 100. In this way, the load size may be reduced so that washing machine appliance 100 may execute the auto wash cycle. Notifying the user of the oversized load may be done in a number of suitable manners. For instance, as one example, washing machine appliance 100 may sound an alarm, washing machine appliance 100 may send a push notification to a user's device, and/or washing machine appliance 100 or a user's device may notify a user via a voice communication. Washing machine appliance 100 may notify users of the oversized load condition in other suitable manners as well.

At (320), method (300) includes determining whether at least some of the articles within the wash chamber of washing machine appliance 100 have been removed within a predetermined time. In some exemplary implementations of method (300), determining whether at least some of the articles within the wash chamber of washing machine appliance 100 have been removed includes determining whether the lid of the washing machine appliance has been moved to the open position within the predetermined time after determining that the load size is greater than the maximum load size threshold at (316). If lid 130 has in fact been moved to the open position within the predetermined time, controller 108 assumes that the user has removed at least some of the articles from the wash chamber of washing machine appliance 100. Accordingly, the control logic proceeds to (308) so that it may be determined if lid 130 is in a closed position so that the load size may be re-detected at (312), e.g., so that a second load size sensing cycle may be performed. In this way, the newly reduced load of articles within the wash chamber may be checked against the minimum and maximum load size thresholds at (314) and (316), respectively, and so the auto wash cycle may be executed at (326). If lid 130 has not been moved to the open position within the predetermined time, it is determined that the user has not removed at least some of the articles from the wash chamber of washing machine appliance 100. Accordingly, the control logic proceeds to (306) so that it may be determined if the current time has met the scheduled time. In this way, method (300) may proceed or continue to wait to proceed until the current time has met the scheduled time.

At (322), prior to executing the auto wash cycle at (326) described below, method (300) includes notifying a user that the auto wash cycle is going to commence within a predetermined time. In this way, the user may have an opportunity to cancel the auto wash cycle before the cycle commences. The predetermined time may be five (5) minutes, for example. Notifying the user of the intent to commence the auto wash cycle may be done in a number of suitable manners, e.g., such as those described above. When the user is notified that the auto wash cycle is going to commence, a timer is started to countdown the predetermined time in which the user may send a cancellation command to washing machine appliance 100.

At (324), method (300) includes determining if the predetermined time has elapsed. If the predetermined time has not elapsed, the control logic loops back to (324) to continue checking if the predetermined has elapsed. If the predetermined time has indeed elapsed, e.g., five (5) minutes from the notification has expired, then the control logic proceeds to (326) as shown in FIG. 4. Of course, if controller 108 of washing machine appliance 100 receives a cancellation command from the user, the auto wash cycle will not be executed at (326).

At (326), method (300) includes executing the auto wash cycle based at least in part on the load size if the load size is greater than the minimum load size threshold and less than the maximum load size threshold. That is, washing machine appliance 100 performs an auto wash cycle based at least in part in accordance with the load size determined at (312), and when washing machine appliance 100 executes the auto wash cycle, the load size is greater than the minimum and greater than the maximum load size thresholds as determined at (314) and (316), respectively. In some implementations, in addition to load size, the parameters of the auto wash cycle may be adjusted or varied based at least in part on a sensed color of the articles within the wash chamber within washing machine appliance 100, the fabric type of the articles, a stain status of the articles, etc.

At (328), in some exemplary implementations, method (300) includes notifying a user that the auto wash cycle has commenced or begun. The user is notified so that the user is aware that washing machine appliance 100 is operating and so that the user may cancel the cycle if desired even though the cycle is in progress. Notifying the user of the commenced auto wash cycle may be done in a number of suitable manners, e.g., such as those described above. Washing machine appliance 100 may notify users of the start of the auto wash cycle in other suitable manners as well.

At (330), in some exemplary implementations, method (300) includes notifying a user that the auto wash cycle has completed. The user is notified so that the user is aware that his or her articles have been washed and that they are ready to be removed from the wash chamber of washing machine appliance 100. Notifying the user of the commenced auto wash cycle may be done in a number of suitable manners, e.g., such as those described above. Thereafter, the control logic proceeds to (332).

At (332), in some exemplary implementations after the auto wash cycle has completed, method (300) includes determining whether articles within the wash chamber have been removed. As one example, determining whether articles within the wash chamber have been removed includes determining whether lid 130 of washing machine appliance 100 has been moved to an open position. On one hand, if it is determined that the articles have not been removed from the wash chamber of washing machine appliance 100, the control logic loops back to (332) until the articles have been removed, e.g., that lid 130 has been opened after the auto wash cycle has completed. On the other hand, if it is determined that the articles have been removed from the wash chamber of washing machine appliance 100, then the control logic proceeds to (306) where method (300) is effectively re-initialized. That is, if it is determined that the articles have been removed from the wash chamber after the auto wash cycle has been completed, the control logic reverts back to (306) so that controller 108 may determine if the current time has met the scheduled time at (306) and if the lid is in the closed position at (308), and if so, execute the load size sensing cycle to detect a second load size of articles within the wash chamber if the lid is in the closed position and the current time has met the scheduled time at (312). After detecting the load size, controller 108 then ascertains if the second load size is greater than the minimum load size threshold at (314) and if the second load size is less than the maximum load size threshold at (316). If the second load size is greater than the minimum load size threshold and less than the maximum load size threshold, controller 108 then executes the auto wash cycle based at least in part on the second load size at (326). Controller 108 may then proceed to (328), (330), and ultimately (332) once more. Method (300) may repeat and run continuously until the auto wash cycle feature is no longer selected.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating a washing machine appliance in an auto wash cycle, the method comprising:

determining if a lid of the washing machine appliance is in a closed position;

detecting a load size of articles within a wash chamber of the washing machine appliance if the lid is in the closed position;

ascertaining if the load size is greater than a minimum load size threshold;

ascertaining if the load size is less than a maximum load size threshold; and executing the auto wash cycle based at least in part on the load size if the load size is greater than the minimum load size threshold and less than the maximum load size threshold.

2. The method of claim 1, further comprising:

determining if a current time has met a scheduled time, wherein the load size of articles within the wash chamber is detected if the current time has met the scheduled time.

3. The method of claim 2, wherein the scheduled time is set for a set time on a predetermined interval.

4. The method of claim 2, wherein the scheduled time is set for a predetermined operating period on a predetermined interval.

5. The method of claim 1, wherein if the lid is not in the closed position, the method further comprises:

notifying a user that the lid is not in the closed position.

6. The method of claim 1, wherein after executing the auto wash cycle, the method further comprises:

notifying a user that the auto wash cycle is completed.

7. The method of claim 1, wherein after the auto wash cycle is completed, the method further comprises:

determining whether articles within the wash chamber have been removed.

8. The method of claim 7, wherein determining whether articles within the wash chamber have been removed comprises determining whether the lid of the washing machine appliance has been moved to an open position.

9. The method of claim 7, wherein if articles within the wash chamber have been removed, the method comprises repeating determining if the lid of the washing machine appliance is in the closed position, detecting the load size of articles within the wash chamber of the washing machine appliance if the lid is in the closed position, ascertaining if the load size is greater than the minimum load size threshold, ascertaining if the load size is less than the maximum load size threshold, and executing the auto wash cycle based at least in part on the load size if the load size is greater than the minimum load size threshold and less than the maximum load size threshold.

10. The method of claim 1, further comprising:

notifying a user that the auto wash cycle is going to commence within a predetermined time, wherein if no cancellation command has been received by the washing machine appliance and the predetermined time has elapsed, the auto wash cycle is executed.

11. The method of claim 1, wherein if the load size is not less than the maximum load size threshold, the method further comprises:

notifying a user that the load size is not less than the maximum load size threshold; and determining whether at least some articles within the wash chamber have been removed within a predetermined time.

12. The method of claim 11, wherein determining whether at least some articles within the wash chamber have been removed within the predetermined time comprises determining whether the lid has been moved to the open position within the predetermined time after determining that the load size is not less than the maximum load size threshold.

13. The method of claim 1, further comprising:

notifying a user that the auto wash cycle has commenced.

14. The method of claim 1, further comprising:

notifying a user that the auto wash cycle has completed.

* * * * *